US011013285B1

(12) United States Patent
Heath

(10) Patent No.: US 11,013,285 B1
(45) **Date of Patent: *May 25, 2021**

(54) HEAD AND NECK RESTRAINING SYSTEM WITH AN ADJUSTABLE TETHER

(71) Applicant: NecksGen, Inc., El Cajon, CA (US)

(72) Inventor: Kevin Brian Heath, El Cajon, CA (US)

(73) Assignee: NecksGen Inc., El Cajon, CA (US)

( * ) Notice: Subject to any disclaimer, the term of this patent is extended or adjusted under 35 U.S.C. 154(b) by 404 days.

This patent is subject to a terminal disclaimer.

(21) Appl. No.: 15/831,501

(22) Filed: Dec. 5, 2017

Related U.S. Application Data

(63) Continuation-in-part of application No. 14/090,185, filed on Nov. 26, 2013, now Pat. No. 10,039,337.

(60) Provisional application No. 62/430,031, filed on Dec. 5, 2016, provisional application No. 61/797,023, filed on Nov. 27, 2012.

(51) Int. Cl.
*A42B 3/04* (2006.01)
*A41D 13/05* (2006.01)

(52) U.S. Cl.
CPC ..... *A42B 3/0473* (2013.01); *A41D 13/0512* (2013.01); *A41D 2300/33* (2013.01)

(58) Field of Classification Search
CPC ..... A42B 3/08; A42B 3/0473; A42B 3/085; A42B 3/142; A42B 3/147; A42B 3/0406; A41D 13/0512; A41D 2300/33; B60R 22/001; B60R 2021/022; B60R 2021/0048; B60R 2022/027; B60R 2022/1818; A63B 71/1291
USPC ..... 2/338, 421, 422, 468
See application file for complete search history.

(56) References Cited

U.S. PATENT DOCUMENTS

| | | | |
|---|---|---|---|
| 602,609 | A | 4/1898 | Tatro |
| 1,144,150 | A | 6/1915 | Marcovsky |
| 2,475,631 | A | 7/1949 | Miller et al. |
| 2,519,352 | A | 8/1950 | Carroll |
| 2,643,836 | A | 6/1953 | Carroll |

(Continued)

FOREIGN PATENT DOCUMENTS

| | | |
|---|---|---|
| DE | 4445219 | 6/1996 |
| DE | 4445219 A1 | 6/1996 |

(Continued)

*Primary Examiner* — Jameson D Collier
(74) *Attorney, Agent, or Firm* — Atlanta Technology Law

(57) ABSTRACT

A head and neck restraining system includes a helmet, a neck brace structure, and a tether system. The neck brace structure includes a neck extension that is attached to shoulder extensions. The tether system includes a single tether with double thickness terminal ends. The double thickness terminal ends have a plurality of pass-through openings that are adapted to receive a removable securing pin that threadably secures the tether to the neck brace. The tether also secures the helmet to the neck brace and limits its range of motion during an accident. The tether is removable secured to the neck brace on one side then extends from the neck brace to the helmet, then continues from the helmet to the back of the neck brace, then continues further from the back of the neck brace to the opposite side of the helmet, and then is removable secured to the other side of the neck brace. The tether may be slidably or fixedly attached to the helmet and neck brace.

18 Claims, 8 Drawing Sheets

(56) References Cited

U.S. PATENT DOCUMENTS 3,072,946 A * 1/1963 La Falce ..... A47K 7/022 15/222
3,074,669 A 1/1963 Bohlin
3,099,261 A 7/1963 Doss et al.
3,134,106 A 5/1964 Shaffer et al.
3,148,375 A 9/1964 Jones
3,278,230 A 10/1966 Boyce et al.
3,329,464 A 7/1967 Barwood et al.
3,499,681 A 3/1970 Benitez, Jr. et al.
3,514,784 A 6/1970 McDavid
3,524,279 A 8/1970 Lavenne
3,559,932 A 2/1971 Ternes
3,632,066 A 1/1972 Brown et al.
3,671,974 A 6/1972 Sims
3,818,509 A 6/1974 Romo et al.
3,848,270 A * 11/1974 Rand ..... A41F 9/002 2/311
3,873,996 A 4/1975 Varteressian
3,900,896 A 8/1975 Ackerman
3,925,822 A 12/1975 Sawyer
4,219,193 A 8/1980 Newman
4,319,362 A 3/1982 Ettinger
4,477,041 A 10/1984 Dunne
4,570,974 A 2/1986 Dove
4,625,335 A 12/1986 Vinai
4,638,510 A 1/1987 Hubbard
4,731,882 A 3/1988 Ekman
4,909,459 A 3/1990 Patterson
4,923,147 A 5/1990 Adams et al.
4,967,985 A 11/1990 Deakin
5,080,191 A 1/1992 Sanchez
5,267,708 A 12/1993 Monson et al.
5,272,770 A 12/1993 Allen et al.
5,301,371 A 4/1994 Chao
5,313,669 A * 5/1994 Rasdell ..... A41F 17/00 2/107
5,437,613 A 8/1995 Reggio et al.
5,620,215 A * 4/1997 Janeway ..... E05B 65/0888 292/256
5,715,541 A 2/1998 Landau
5,738,046 A 4/1998 Williams et al.
5,807,218 A * 9/1998 Nagatomo ..... A61F 5/3715 128/869
5,983,463 A * 11/1999 Prentkowski ..... A44B 11/2557 24/171
6,006,860 A 12/1999 Bell
6,009,566 A 1/2000 Hubbard
6,125,966 A 10/2000 Jones
6,128,782 A 10/2000 Young et al.
6,308,345 B1 10/2001 Williams, Jr.
6,330,722 B1 12/2001 Betts
6,381,758 B1 5/2002 Roberts, II et al.
6,405,685 B1 6/2002 Cox
6,428,043 B1 8/2002 Wooten
6,499,149 B2 12/2002 Ashline
6,588,022 B1 7/2003 Anders et al.
6,591,430 B1 7/2003 Sledge
6,619,751 B1 9/2003 Shah
6,751,809 B1 6/2004 Cooper et al.
6,810,535 B1 11/2004 Moloney
6,813,782 B2 11/2004 Kintzi et al.
6,871,360 B1 3/2005 Ashline
6,931,669 B2 8/2005 Ashline
7,017,194 B2 * 3/2006 Schroth ..... A42B 3/0473 2/410
D522,178 S 5/2006 Ashline
7,120,982 B2 10/2006 Downing et al.
7,155,747 B2 1/2007 Baker
7,380,290 B2 6/2008 Mothaffar
7,395,558 B2 7/2008 Mothaffar
7,404,402 B2 7/2008 Yu
7,509,691 B1 3/2009 Wingate
D597,212 S 7/2009 Stiles
7,703,150 B2 4/2010 Wagner et al.
7,703,152 B2 4/2010 Rhodes et al.
7,765,623 B2 8/2010 Ashline
7,823,925 B2 11/2010 Sargent
D631,167 S * 1/2011 Leatt ..... D24/191
D649,649 S * 11/2011 Leatt ..... D24/191
8,272,074 B1 * 9/2012 Ashline ..... A42B 3/0473 2/421
8,375,472 B2 2/2013 Ashline
9,351,529 B1 5/2016 Ashline
2001/0002087 A1 5/2001 Townsend
2002/0043831 A1 4/2002 Alsup
2003/0045408 A1 * 3/2003 Seles ..... A63B 23/03525 482/121
2005/0015858 A1 * 1/2005 Ashline ..... A42B 3/0473 2/421
2005/0204457 A1 * 9/2005 Stiles ..... A41D 13/0512 2/425
2005/0206151 A1 * 9/2005 Ashline ..... B60R 22/001 280/801.1
2007/0067896 A1 * 3/2007 Sargent ..... B60R 22/001 2/468
2008/0256684 A1 * 10/2008 Ashline ..... A42B 3/0406 2/411
2010/0088809 A1 * 4/2010 Leatt ..... A42B 3/0473 2/468
2010/0107310 A1 * 5/2010 Taylor ..... A41F 9/002 2/301
2010/0229290 A1 * 9/2010 Nelson ..... B60R 22/001 2/425
2010/0286580 A1 * 11/2010 Leatt ..... A61F 5/055 602/18
2010/0306902 A1 * 12/2010 Bourque ..... A45C 13/30 2/244
2011/0092347 A1 * 4/2011 Kassel ..... A63B 21/1663 482/121
2012/0137418 A1 * 6/2012 Nelson ..... A42B 3/0473 2/468
2020/0068977 A1 * 3/2020 Heath ..... A41D 13/0512

FOREIGN PATENT DOCUMENTS

DE 100 50 310 C1 3/2002
DE 100 50 310 C1 7/2002
DE 103 14 423 B3 2/2004
DE 103 14 423 B3 9/2004
GB 2 225 708 A 6/1990
GB 2225708 6/1990
WO 9103178 3/1991
WO WO1991/03178 3/1991
WO 9305986 4/1993
WO WO1993/05986 4/1993
WO WO2002/085145 A2 10/2002
WO WO 2005/023592 A2 3/2005

* cited by examiner

HEAD AND NECK RESTRAINING SYSTEM WITH AN ADJUSTABLE TETHER

CROSS REFERENCE TO RELATED APPLICATIONS

This application claims priority to provisional patent application Ser. No. 62/430,031 filed on Dec. 5, 2016, and is a continuation-in-part of nonprovisional patent application Ser. No. 14/090,185, entitled "Head and Neck Restraining System" filed on Nov. 26, 2013, and is now U.S. Pat. No. 10,039,337 issued on Aug. 7, 2018, which claims priority to U.S. provisional application entitled, "Tension Neutralizing Tether," having Ser. No. 61/797,023, filed on Nov. 27, 2012, all of which are entirely incorporated herein by reference.

TECHNICAL FIELD

The present disclosure is generally related to a safety system and, more particularly, is related to systems and methods for reducing the force exerted on a user's head and neck in a restrained torso condition in event of an accident.

BACKGROUND

A helmet is typically worn to protect the head from injuries, especially in high speed competition or recreational vehicles such as race cars, aircraft, boats etc. In low or high speed conditions, a head and neck restraining system can be implemented to reduce forces exerted on a driver's (user's) head and neck, in event of an accident. For example, in U.S. Pat. Nos. 4,638,510; 6,009,566, and 7,017,194, a head and neck restraining system includes a stiff U-shaped shoulder yoke with a high collar that is tethered to a user's helmet by at least one tether. Each tether is attached to the helmet and the high collar in a horizontal plane, resulting in a lateral load transfer and creating a condition where the helmet and the head and neck restraint is cantilevered at the tether-helmet attachment points.

Desirable in the art is an improved head and neck restraining system that would improve upon the conventional head and neck restraining system.

SUMMARY

A new head and neck restraining system is disclosed herein. The system includes a helmet, a neck brace structure, and a tether system. The neck brace structure includes a neck extension that is attached to shoulder extensions. The tether system includes at least one ring structure that is configured to attach to the helmet and a single tether material that slides through the at least one ring. The single tether material is guided along the neck extension and attached to the shoulder extensions. There is at least one ring structure positioned between the neck and shoulder extensions along the single tether material and splits the load from the helmet to the neck extension and the shoulder extension along the single tether material.

Other systems, devices, and features of the invention will be or will become apparent to one skilled in the art upon examination of the following figures and detailed description. It is intended that all such systems, devices, and features be included within the scope of the invention, and be protected by the accompanying claims.

BRIEF DESCRIPTION OF DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, the reference numerals designate corresponding parts throughout the several views. While several embodiments are described in connection with these drawings, there is no intent to limit the disclosure to the embodiment or embodiments disclosed herein. On the contrary, the intent is to cover all alternatives, modifications, and equivalents.

DETAILED DESCRIPTION

Exemplary systems are first discussed with reference to the figures. Although these systems are described in detail, they are provided for purposes of illustration only and various modifications are feasible. After the exemplary systems are described, examples of a tethering system are provided to explain the manner in which the force exerted on a user's head and neck is reduced.

Figure 1:
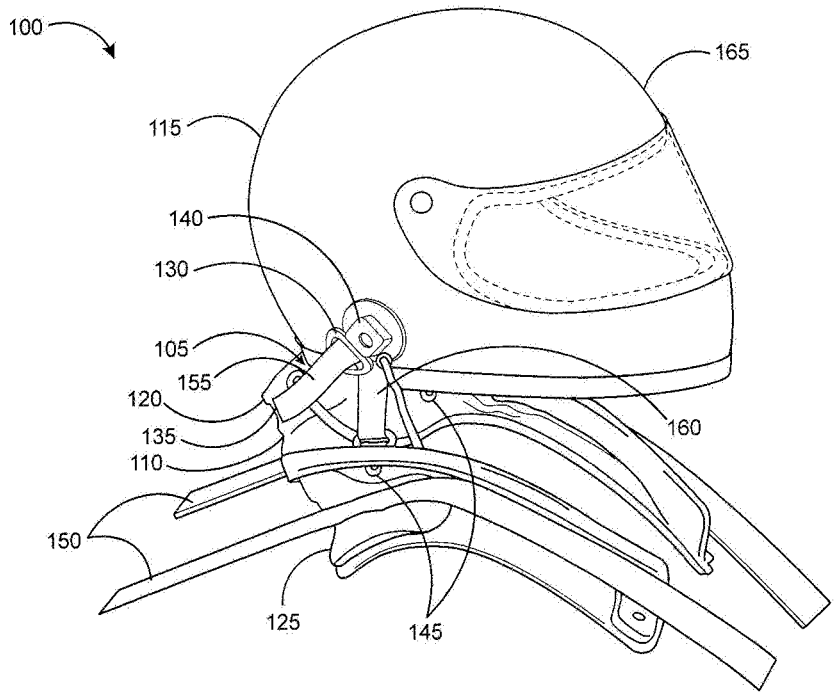
FIG. 1 is a side view that illustrates an embodiment of a neck and head system having a tethering system and a neck brace structure.

FIG. 1 is a side view that illustrates an embodiment of a neck and head system 100 having a tethering system 105 and a neck brace structure 110. The tethering system 105 tethers a helmet 115 to the neck brace structure 110. The helmet 115 is a structure that a head of a user is enclosed therein. The helmet 115 can restrain the head under high impact or load when tethered to a neckbrace, held in place by the seatbelts. The neck brace structure 110 is contoured to a user's neck and includes a neck extension 120 that contains the routing channel for the tether. The neck extension 120 is attached to shoulder extensions 125 that are lateral flares with respect to the neck extension 120. The shoulder extensions 125 are contoured and rest on the left and right sides of a user's shoulders in a restrained torso condition in a vehicle with shoulder harness style seatbelt 150. In this example, the shoulder harness style seatbelt incorporating two shoulder belts 150 are placed on top of the shoulder extensions 125.

The tethering system 105 tethers the helmet 115 to the neck brace structure 110, The tethering system 105 includes ring structures 130 that are attached to the helmet 115 by way of, for example, bolts and nuts, integral to the helmet 115 or a latching system. The tethering system 105 further includes a single tether material 135 that slides through the ring structures 130. The single tether material 135 is a flexible, strong material that can withstand the loads required for this application. This tether material is made from but is not limited to, at least one of the following: KEVLAR® (a type of para-aramid fiber), polyester, nylon webbing, rope, strap and cable.

The single tether material 135 can be guided and slide along the neck extension 120 and is attached to the shoulder extensions 125 via a fixed end mount points 145, such as a bolt and nut. In this example, the single tether material 135 starts and ends on opposite sides of the neck brace structure 110 at fixed end mount points 145. The single tether material 135 wraps around the outer surface near a top portion of the neck extension 120 and is routed through fixed points at the helmet 115 that can be positioned at or near the lower center of the left and right side of the helmet 115.

The fixed end mount points 145 can be positioned at a location of the shoulder extensions 125 that is near the neck extension 120 and above and adjacent to the seatbelts 150. In other words, the fixed end mount points 145 can be positioned to the neck brace structure 110 on the left and the right side at the most forward and lowest position. It should be noted that the closer the fixed end mount points 145 to the seatbelts 150 the more efficient the load transfer is from the helmet 115 to the seatbelts 150. Alternatively or additionally, the fixed end mount points 145 can be positioned at the bottom of the neck extension 120 near the shoulder extensions 125 or anywhere on the shoulder extensions 125. The ring structure 130 is positioned between the neck and shoulder extensions 120, 125 along the single tether material 135 and is attached to the helmet 115 at the fixed points.

The helmet 115 can include rotating buckles 140 at the fixed points that are configured to fasten the ring structure 130 of the tethering system 105 to the helmet 115. The single tether material 135 is guided along the neck extension 120 and routed through the opening of the ring structure 130 that is fastened to the helmet via the rotating buckles 140, allowing the ring structure 130 to move freely with no interference from the rotating buckle 140 under normal conditions of head movement. The ring structure 130 splits the load 155, 160 from the helmet 115 to the neck and shoulder extensions 120, 125 through the single tether material 135. The load 165 on the helmet 115 can be distributed to substantially the entire neck brace structure 110 and can create load paths that split the load on each side of the helmet 115 in halves, for example. The ring structure 130 allows the tethering system 105 to slide as the head and helmet 115 move in the direction of the exerted forces. This has the effect of equalizing the load 160 on the fixed end mount points 145 and the load 105 to each side of 120, creating four equal load paths.

The single tether material 135 is routed through the opening of the ring structure 130 and attached to the fixed end mount 145 on the shoulder extension 125, positioning the ring structure 13 between the neck and shoulder extensions 120, 125. In event of an accident the driver's (user's) body is held in place by the seat belts 150. The neck brace structure is held in place under the left and right shoulder belts of the seat belts. The head of the driver (user) is restrained from moving towards the direction of the impact in an excessive distance from the upper torso by the tethering system 105 that is attached to the neck brace structure 110 and the helmet 115, in effect becoming a seatbelt for the head. The resultant load from the head moving forward is transferred from the helmet 115 to the neck brace structure 110 via the tethering system 105. The tethering system 105 that is attached to the helmet 115 equalizes the load, which is dispersed evenly from the helmet 115 through four load paths 155, 160 on the neck brace structure 110.

Figure 2:
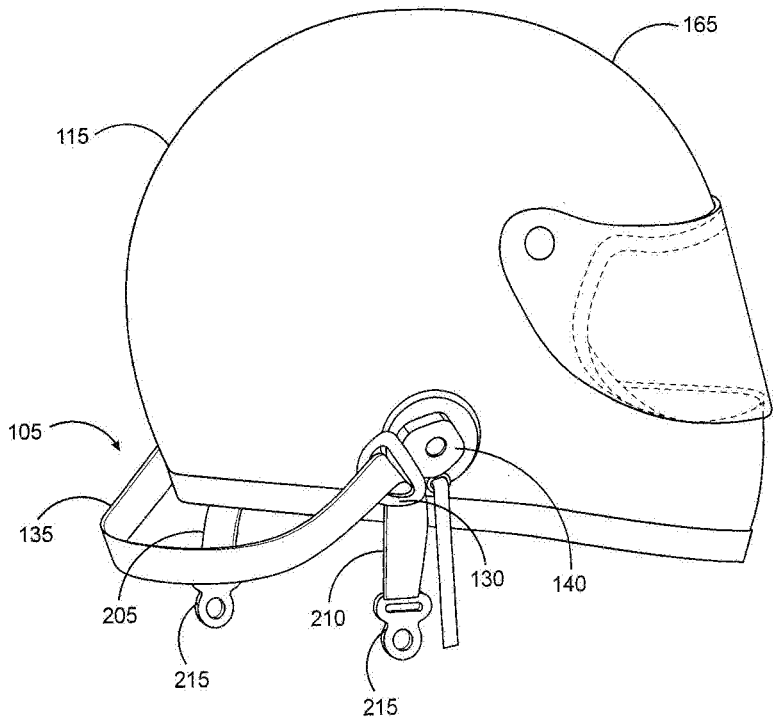
FIG. 2 is a rear side view that illustrates an embodiment of a head and neck tethering system having a tethering system, such as that shown in FIG. 1.

FIG. 2 is a rear side view that illustrates an embodiment of a neck and head system 100 having a tethering system 105, such as that shown in FIG. 1. In this example, the single tether material 135 of the tethering system 105 can be attached to the shoulder extensions 125 of the neck brace structure 110 on each end 205, 210 of the single tether material 135. The ends 205, 210 can be attached with an O-ring tongue 215 that is configured to fasten to fixed end mount points 145 of the shoulder extensions 125, allowing the O-ring tongue 215 to swivel such that the tethering system 105 can self-align in the direction of the force.

By attaching the ends 205, 210 of the single tether material 135 to the left and right shoulder extensions 125, positioning the ring structure 130 between the neck and shoulder extensions 120, 125 and attaching the ring structure 130 to the helmet 115 at the fixed points, the tethering system 105 is a continuous loop between the shoulder extensions 125, creating a double line pulley effect on the ring structure 130 where the loads 155, 160 can be divided in halves.

This arrangement provides four load paths 155, 160 to the neck and head restraining system 100. In a collision, the user's head and helmet 115 are forced in the direction of the impact. The tension can be transferred equally through the shell of the helmet 115 to the ring structures 130 attached at the fixed points on the helmet 115. The load 165 can be split equally from left to right and upper to lower by way of the ring structure 130. A portion of the load 160 is transferred to the fixed end mount points 145 on one of the shoulder extensions 125 and the other portion of the load 155 is transferred to the neck extension 120. This can result in a load 165 that can be distributed equally throughout the single tether material 135 to the neck brace structure 110 and to the seatbelts 150 which encapsulate the neck and head restraining system 100. The load 165 can be distributed in most directions or in any direction that the head and helmet 115 moves forward or sideward.

If the load 165 on the helmet 115 is 4,000 lbs., a load of 2,000 lbs. can be distributed to each sides of the helmet 115. At each side of the helmet, a load 155, 160 of 1,000 lbs. can be distributed to each of the neck and shoulder extensions 120, 125 in a double line pulley by way of the ring structure 130 and then distributed to the seatbelts 150. This feature allows the load 165 to be distributed equally through the four load paths 155, 160 at any angle or direction of the force.

Figure 3:
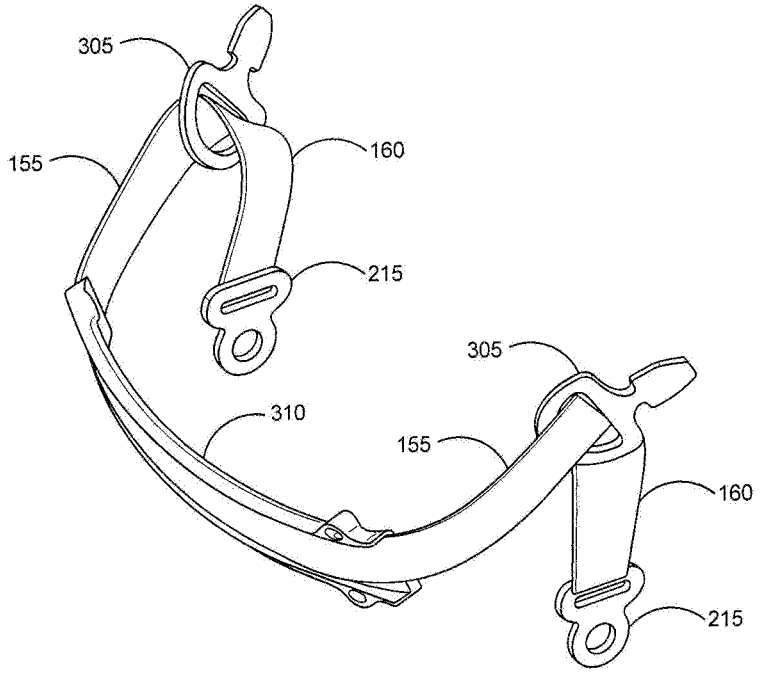
FIG. 3 is a perspective view that illustrates an embodiment of a tethering system, such as that shown in FIG. 2.
Figure 4:
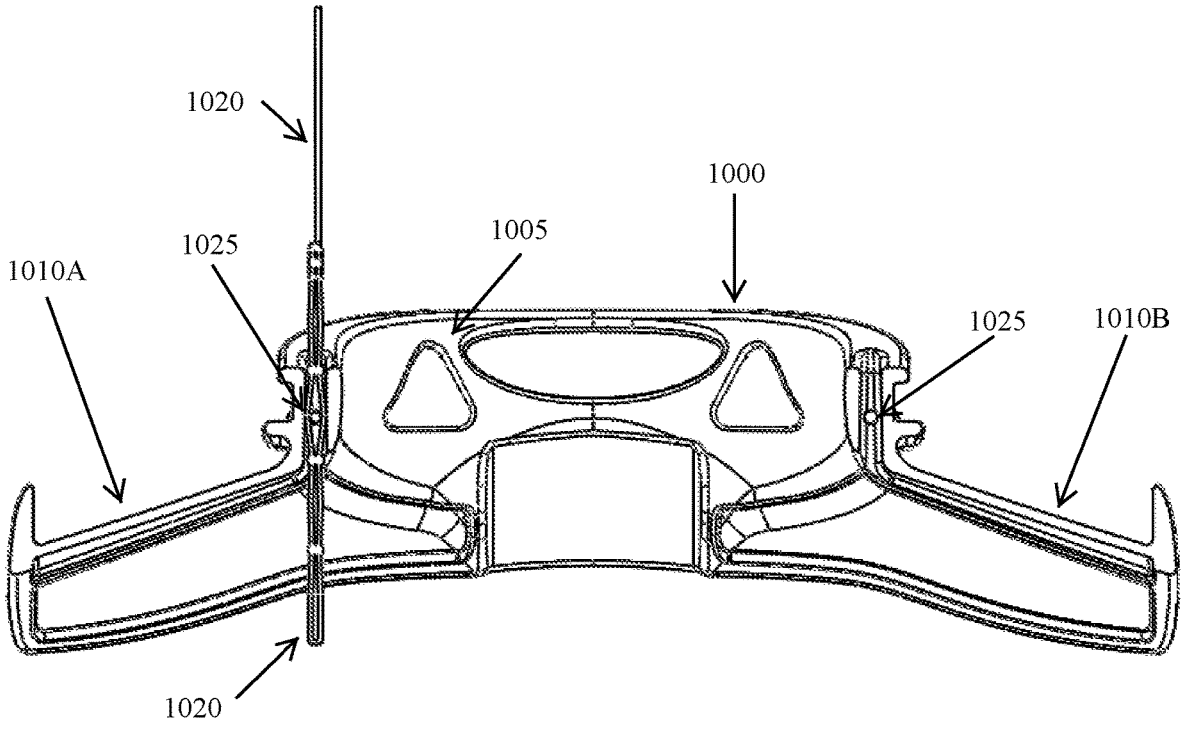
FIG. 4 is a front perspective view of an alternative embodiment of the tethering system.
Figure 5:
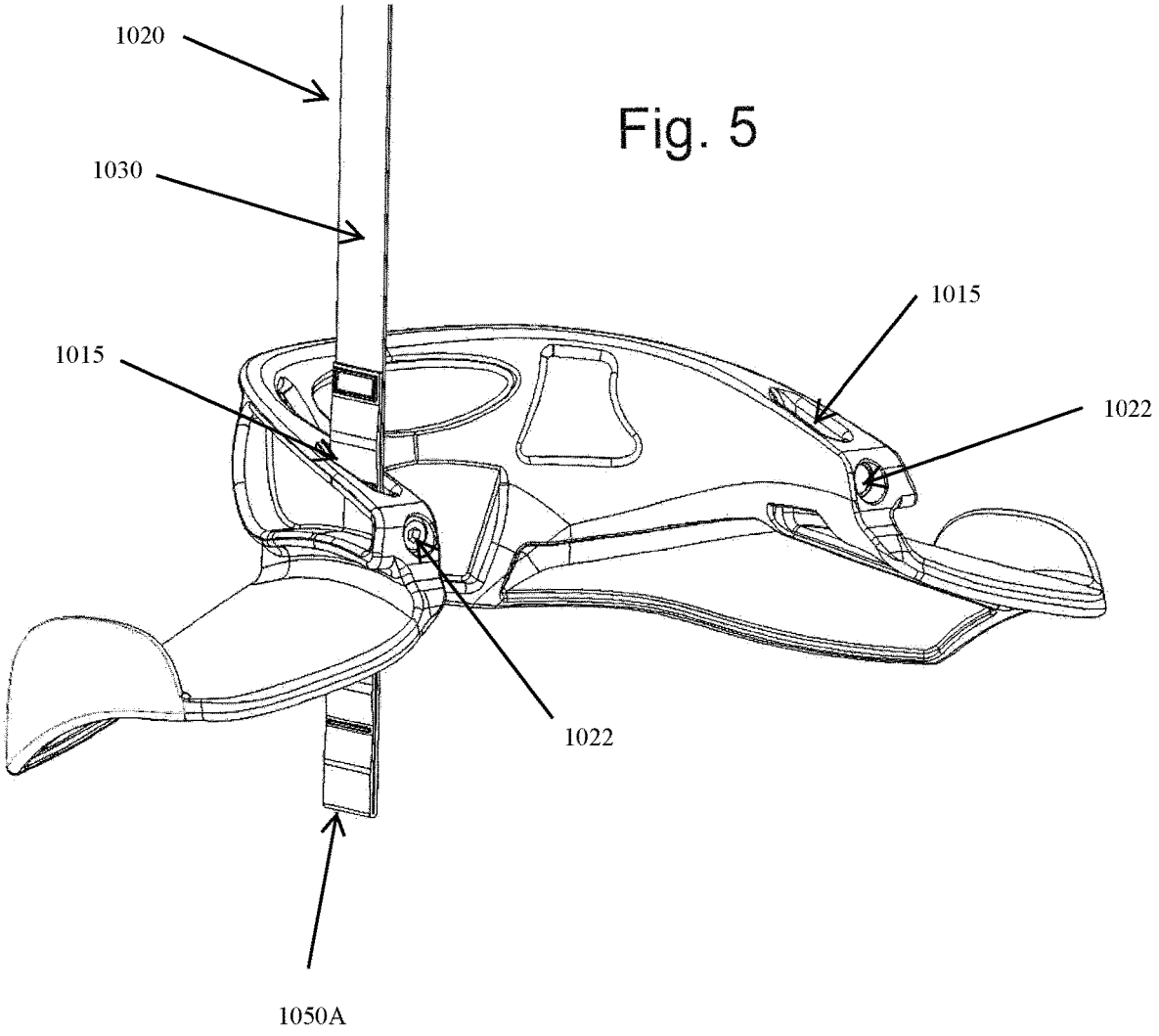
FIG. 5 is a front perspective view of an alternative embodiment of the tethering system.
Figure 6:
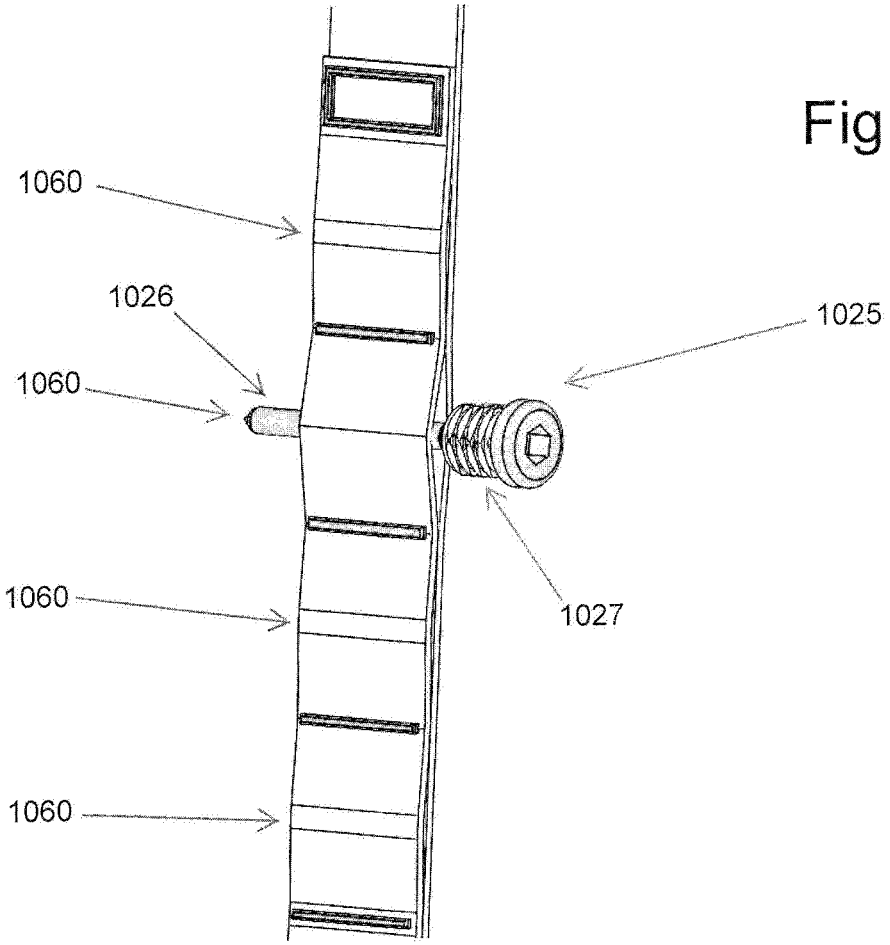
FIG. 6 is a view of the tethering strap and attachment pin used in the alternative embodiment tethering system.
Figure 7:
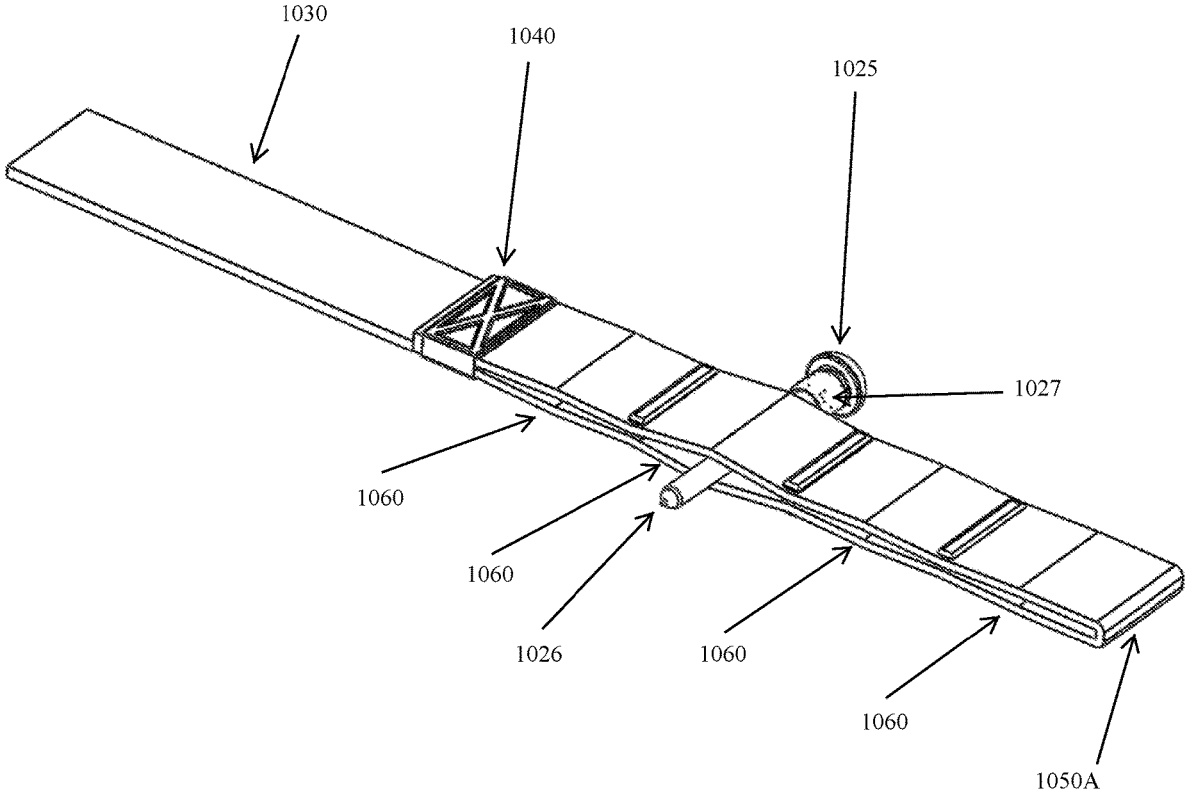
FIG. 7 is a view of the tethering strap and attachment pin used in the alternative embodiment tethering system.
Figure 8:
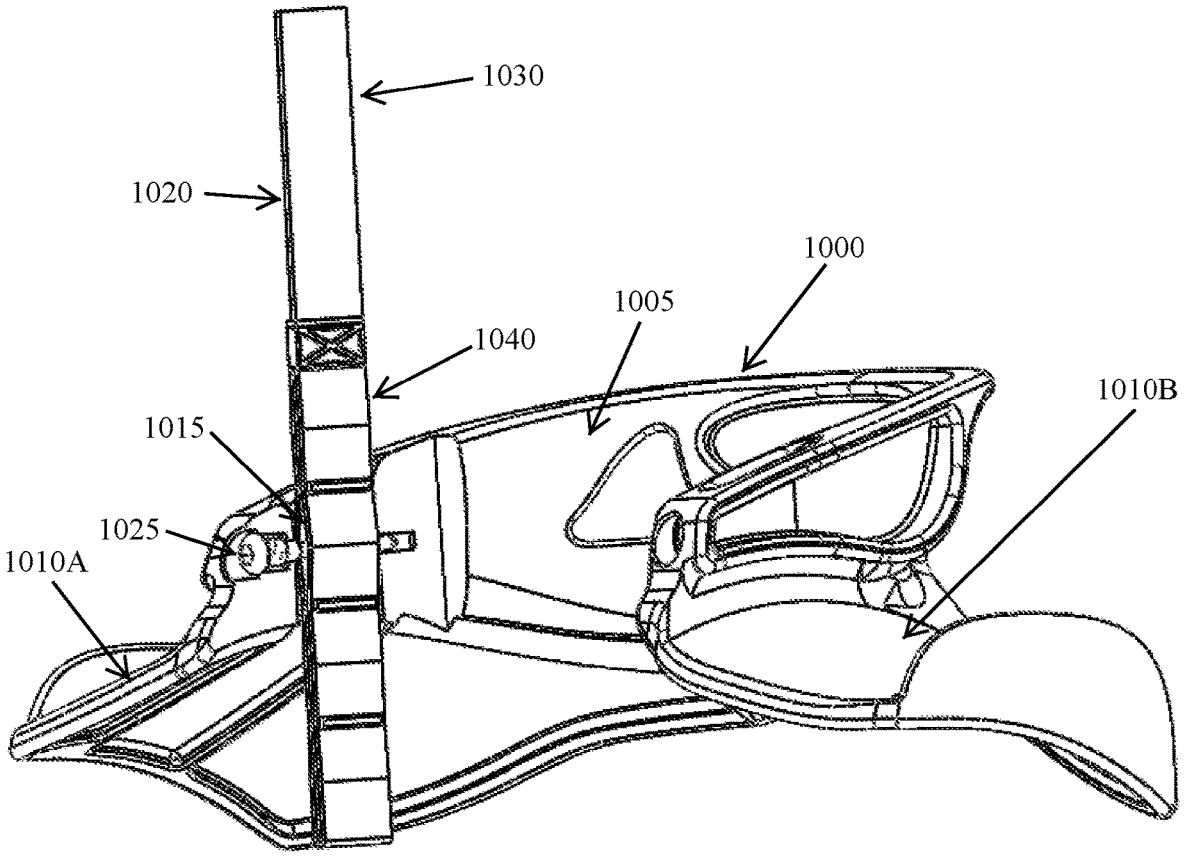
FIG. 8 is a cutaway view of FIG. 5 showing how the attachment pin attaches to the neck brace and secures the tether to the neck brace.

FIG. 3 is a perspective view that illustrates an embodiment of a tethering system 105, such as that shown in FIG. 2. In this example, the ring structure 130 is a D-ring with a tongue 305 that can be attached to the buckle 140 on the helmet 115. The single tether material 135 slides along the neck extension 120 in a tether housing 310 and through the ring structures 130 that can be attached to the neck extension 120, the sliding motion of which allows the tethering system 105 to self-neutralize the tension created by exerted forces.

An alternative embodiment is presented in FIGS. 5 through 8. In the alternative embodiment the neck brace 1000 structure comprises a neck extension 1005 attached to a shoulder extension 1010 A and 1010B, wherein the neck extension 1005 is generally "U" shaped and configured to fit the back of a driver's neck and rest on top of the driver's shoulders. The neck brace 1000 has a first channel 1015 passing through the neck brace 1000 from the top of the neck extension 1005 to the bottom of the neck extension 1005. The first channel 1015 is preferably proximate to the distal end of the neck extension 1005 to allow the tether 1020 to attach to the side of a driver's helmet (not shown) generally proximate to a driver's ear. Located on the distal ends of the neck extension 1005 is a second channel 1022 for receiving a securing means. The second channel 1022 extends from the distal end of the neck extension 1005 and bisects the first channel 1015. The securing means may consist of an attachment pin 1025. The attachment pin 1025 can be threaded or unthreaded. The shoulder extension 1010 A and 1010B are adapted to receive a shoulder belt (not shown).

The tether 1020 has a single thickness length 1030 and a double thickness length 1040. The double thickness length 1040 consists of folding the tether 1020 over on itself at the distal ends (one distal end 1050A is shown in the figures, while the other distal end is not shown) and fixedly attaching the tether 1020 of the double thickness length 1040 together at intervals while leaving the sections between unattached to define a plurality of pass through openings (1060) in the double thickness length 1040 of the tether 1020.

In the preferred alternative embodiment, the attachment pin 1025 has a smooth shaft distal end 1026 adapted to fit the pass through opening 1060 in the double thickness length 1040 and the other distil end is threaded 1027 to attach to the neck brace 1000. The attachment pin 1025 can be recessed in the terminal end of the neck brace 1000 so that it does not snare anything or interfere with the users operation.

The alternative embodiment allows for the easy and quick adjustment of the tether length for a users comfort and safety. To adjust the length of the tether 1020 the attachment pin 1025 is removed from the neck brace 1000 by unscrewing it. The tether length is then adjusted by sliding its position through the channel 1015 in the neck brace 1000. Then the attachment pin 1025 is reinserted in the neck brace 1000, threaded through one of the plurality of pass through openings 1060 in the tether, and then screwed tight to ensure that the tether is secure.

The tether 1020 is removable secured to the neck brace 1000 on a first side then extends from the neck brace 1000 to the helmet (not shown), then continues from the helmet to the back of the neck brace 1000, then continues further from the back of the neck brace 1000 to the opposite side of the helmet, and then is removable secured to the other side of the neck brace 1000. The tether 1020 may be slideably or fixedly attached to the helmet and neck brace 1000.

This description has been presented for purposes of illustration and description. It is not intended to be exhaustive or to limit the disclosure to the precise forms disclosed. Obvious modifications or variations are possible in light of the above teachings. The embodiments discussed, however, were chosen to illustrate the principles of the disclosure, and its practical application. The disclosure is thus intended to enable one of ordinary skill in the art to use the disclosure, in various embodiments and with various modifications, as are suited to the particular use contemplated. All such modifications and variation are within the scope of this disclosure, as determined by the appended claims when interpreted in accordance with the breadth to which they are fairly and legally entitled.

The invention claimed is:

1. A tether apparatus for use with a head and neck restraining device, the tether apparatus comprising:

a tether with two terminal ends having a double thickness section at each terminal end, wherein the double thickness sections of the tether have a plurality of pass-through openings;

a neck brace comprising a neck extension, wherein the neck brace has a first channel passing through the neck brace from a top side of the neck extension to a bottom side of the neck extension, wherein the first channel is adapted to receive the double thickness section of the tether;

wherein the neck brace structure has a second channel that bisects the first channel, the tether apparatus further includes a securing means, wherein the second channel is adapted to receive the securing means for threadably attaching the tether to the neck brace by passing the securing means through one of the pass-through openings in the tether.

2. The tether apparatus of claim 1 wherein the securing means is a threaded pin with a first smooth shaft distal end adapted to fit through one of the pass-through openings in the tether and a second distal end threaded to attach to the neck brace.

3. The tether apparatus of claim 1 wherein the tether has a single thickness section between the double thickness sections of the tether.

4. The tether apparatus of claim 1 wherein the tether is attached to a back side of the neck extension.

5. The tether apparatus of claim 1 wherein the tether is attachable to a helmet.

6. The tether apparatus of claim 1 wherein the neck brace has two terminal ends and is configured to fit on a driver's shoulders.

7. The tether apparatus of claim 6 wherein the tether is slidably attachable to a driver's helmet and slidably attached to a back side of the neck extension.

8. The tether apparatus of claim 7 wherein the tether is slidably attachable to a right side of the helmet and slidably attachable to a left side of the helmet.

9. A tether apparatus for use with a head and neck restraining device, the tether apparatus comprising:

a tether with two terminal ends having a double thickness section at each terminal end, wherein the double thickness sections of the tether have a plurality of pass-through openings;

a neck brace comprising a neck extension with two terminal ends, wherein the neck brace has two first channels proximate to the terminal ends of the neck extension, the two first channels passing through the neck brace from a top side of the neck extension to a bottom side of the neck extension, the two first channels being adapted to receive the double thickness section of the tether;

the neck brace has two second channels, each second channel extends from one of the terminal ends of the neck extension to bisect a respective one of the two first channels, wherein each second channel is adapted to receive a pin for threadably attaching the tether to the neck brace by extending the pin through one of the pass-through openings of the tether.

10. The tether apparatus of claim 9 wherein the pin has a first smooth shaft distal end adapted to fit one of the pass-through openings in the tether and a second distal end threaded to attach to the neck brace.

11. The tether apparatus of claim 9 wherein the tether is slidably attachable to a driver's helmet and slidably attached to a back side of the neck extension.

12. The tether apparatus of claim 11 wherein the tether is slidably attachable to a right side of the helmet and to a left side of the helmet.

13. A tether apparatus for use with a head and neck restraining device, the tether apparatus comprising:

a tether with two terminal ends having a double thickness section at each terminal end and a single thickness section between the double thickness sections at each terminal end, wherein each of the double thickness sections of the tether further includes a pin, wherein the double thickness sections each have a plurality of pass-through openings, wherein the plurality of pass-through openings are configured for the respective pin to pass through;

a neck brace comprising two shoulder extensions and a neck extension with a first terminal end and a second terminal end, wherein the neck brace has two first channels proximate to the terminal ends of the neck extension passing through the neck brace from a top side of the neck extension to a bottom side of the neck extension, the two first channels are adapted to receive the double thickness sections of the tether;

the neck brace has two second channels, wherein a first one of the two second channels is located on the first terminal end of the neck extension and a second one of the two second channels is located on the second terminal end of the neck extension, one of the two second channels extends from the first terminal end of the neck extension to bisect one of the first channels and the other one of the two second channels extends from the second terminal end of the neck extension to bisect the other of the first channels, wherein the tether apparatus further includes a pin, wherein the second channels are adapted to receive the pin for threadably securing the tether to the neck brace by extending the pin through one of the pass-through openings of the tether.

14. The tether apparatus of claim 13 wherein the pin has a first smooth shaft distal end adapted to fit the one of the pass-through openings in the tether and a second distal end threaded to attach to the neck brace.

15. The tether apparatus of claim 13 wherein the tether is attachable to a helmet.

16. The tether apparatus of claim 13 wherein the tether is attached to a back side of the neck extension.

17. The tether apparatus of claim 13 wherein the tether is slidably attachable to a helmet and slidably attachable to a back side of the neck extension.

18. The tether apparatus of claim 17 wherein the tether is slidably attachable to a right side of the helmet and to a left side of the helmet.

* * * * *